US012286871B2

(12) United States Patent
Ely

(10) Patent No.: US 12,286,871 B2
(45) **Date of Patent: *Apr. 29, 2025**

(54) METHOD FOR PREVENTING INFLUX OF FLUID DURING FRACTURING OF AN OFFSET WELL

(71) Applicant: Ely and Associates, LLC, Houston, TX (US)

(72) Inventor: John W. Ely, Montgomery, TX (US)

(73) Assignee: Ely and Associates, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/220,566

(22) Filed: Jul. 11, 2023

(65) Prior Publication Data

US 2023/0358124 A1 Nov. 9, 2023

Related U.S. Application Data

(63) Continuation of application No. 17/949,146, filed on Sep. 20, 2022, now Pat. No. 11,697,976, which is a continuation of application No. 17/134,893, filed on Dec. 28, 2020, now Pat. No. 11,448,036, which is a continuation of application No. 16/922,689, filed on Jul. 7, 2020, now Pat. No. 10,895,126, which is a continuation of application No. 14/979,560, filed on Dec. 28, 2015, now Pat. No. 10,704,356.

(51) Int. Cl.

| | |
|---|---|
| ***E21B 43/26*** | (2006.01) |
| ***E21B 29/02*** | (2006.01) |
| ***E21B 33/138*** | (2006.01) |

(52) U.S. Cl.
CPC ..... *E21B 43/26* (2013.01); *E21B 29/02* (2013.01); *E21B 33/138* (2013.01); *E21B 43/261* (2013.01)

(58) Field of Classification Search
CPC ..... E21B 33/138; E21B 29/02; E21B 43/261
USPC ..... 166/281
See application file for complete search history.

(56) References Cited

U.S. PATENT DOCUMENTS

| | | | | |
|---|---|---|---|---|
| 4,716,964 | A * | 1/1988 | Erbstoesser | C08G 63/08 166/278 |
| 5,074,360 | A | 12/1991 | Guinn | |
| 9,840,900 | B2 * | 12/2017 | Snider | E21B 43/26 |
| 2009/0255674 | A1 | 10/2009 | Boney et al. | |
| 2013/0062055 | A1 | 3/2013 | Tolman et al. | |

OTHER PUBLICATIONS

USPTO Non-Final Office Action for U.S. Appl. No. 14/979,560 dated Dec. 9, 2016.
USPTO Final Office Action for U.S. Appl. No. 14/979,560 dated May 17, 2017.

(Continued)

*Primary Examiner* — Zakiya W Bates
*Assistant Examiner* — Ashish K Varma
(74) *Attorney, Agent, or Firm* — Tumey L.L.P.

(57) ABSTRACT

Method is provided for preventing fluid from entering a well, such as a producing well, during a hydraulic fracturing treatment in another well completed in the same reservoir. Degradable ball sealers or degradable particulate material is injected into the well and pressure is maintained in the well during the fracturing treatment to prevent influx of fluid.

20 Claims, 1 Drawing Sheet

(56) References Cited

OTHER PUBLICATIONS

USPTO Non-Final Office Action for U.S. Appl. No. 14/979,560 dated Oct. 26, 2017.
USPTO Final Office Action for U.S. Appl. No. 14/979,560 dated Mar. 16, 2018.
USPTO Non-Final Office Action for U.S. Appl. No. 14/979,560 dated Feb. 7, 2019.
USPTO Final Office Action for U.S. Appl. No. 14/979,560 dated Sep. 11, 2019.
USPTO Notice of Allowance for U.S. Appl. No. 14/979,560 dated Mar. 2, 2020.
USPTO Non-Final Office Action for U.S. Appl. No. 16/922,689 dated Aug. 17, 2020.
USPTO Notice of Allowance for U.S. Appl. No. 17/134,893 dated May 9, 2022.
USPTO Notice of Allowance for U.S. Appl. No. 16/922,689 dated Sep. 14, 2020.
USPTO Issue Notification for U.S. Appl. No. 17/134,893 dated Aug. 31, 2022.
USPTO Issue Notification for U.S. Appl. No. 16/922,689 dated Dec. 29, 2020.
USPTO Issue Notification for U.S. Appl. No. 14/979,560 dated Jun. 17, 2020.
USPTO Notice of Allowance for U.S. Appl. No. 17/949,146 dated Feb. 13, 2023.

* cited by examiner

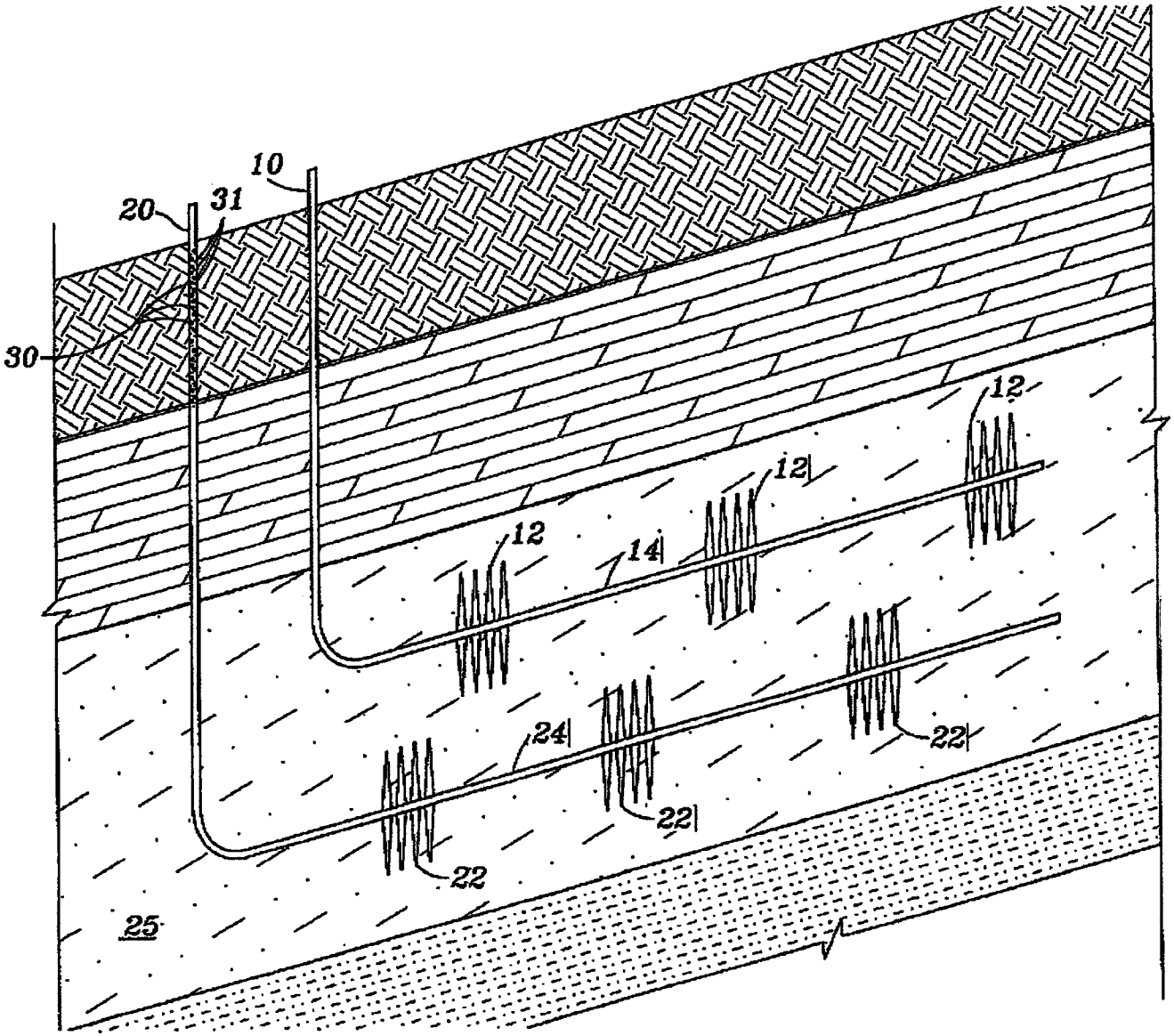
10
31
20
30
12
12
12
14
22
22
22
24
25

METHOD FOR PREVENTING INFLUX OF FLUID DURING FRACTURING OF AN OFFSET WELL

This application is a continuation of U.S. application Ser. No. 17/949,146 filed on Sep. 20, 2022, which is a continuation of U.S. application Ser. No. 17/134,893 filed on Dec. 28, 2020, which is a continuation of U.S. application Ser. No. 16/922,689 filed on Jul. 7, 2020, which is a continuation of U.S. application Ser. No. 14/979,560 filed on Dec. 28, 2015, the disclosures of which are incorporated by reference herein in their entirety.

BACKGROUND OF THE INVENTION

Field of the Invention

Method for improving results of hydraulic fracturing in heterogeneous reservoirs. More specifically method is provided for preventing fluid from entering a well during or soon after hydraulic fracturing of an offset well completed in the same reservoir.

Description of Related Art

Hydraulic fracturing in unconventional reservoirs has increased in many parts of the world in recent years. Large amounts of fracturing fluid may be injected into a well in an effort to open more rock to allow hydrocarbons to be produced from the reservoir. Hydraulic fractures in conventional reservoirs (that are not naturally fractured) are formed in a preferred direction and the fracturing fluid leaks from a plane in fractured rock. Fracturing fluids do not move for long distances away from the confined vertical fracture. In contrast, in unconventional reservoirs the rock is often naturally fractured and when a hydraulic fracturing treatment is performed, fracturing fluid may flow far away from the well being fractured in different directions.

It has been observed in the field that fracturing fluids from fracturing treatments in offset wells in various directions may be produced into a producing well in the same reservoir or reservoir fluids may be temporarily produced at a higher rate. This is a disadvantage, because fracturing fluid or water near the producing well may decrease production rate of hydrocarbons and may require disposal of additional water.

What is needed is a simple and inexpensive method of preventing fracturing fluid from offset wells or additional reservoir water flowing into a producing well in the same reservoir as another well is being fractured.

BRIEF DESCRIPTION OF THE DRAWING(S)

FIG. 1 is an isometric view of two horizontal wells completed in the same naturally fractured reservoir.

DETAILED DESCRIPTION OF THE INVENTION

Referring to FIG. 1, well 10 and well 20 are completed in naturally fractured reservoir 25. The wells are completed by perforations 12 in well 10 and 22 in well 20. Alternatively, openings in casings 14 and 24 may be provided by ports controlled by sliding sleeves or any other types of opening in casings 12 and 22.

The following procedure may be followed when well 10 is to be hydraulically fractured and it is desired to prevent influx of fracturing or reservoir fluid into well 20. Before injection of fracturing fluid into well 10 or soon after injection begins, degradable ball sealers 30 or degradable particles 31, or both, together or separately, may be injected into well 20 in a carrier fluid such as water or a fracturing fluid. Injection of fluid into well 20 is continued and sufficient ball sealers or degradable particles are injected to provide partial or complete shut-off of all perforations 22 in well 20, i.e., ball sealer or degradable particle injection may continue until a "ball-out" of well 20 is observed. A ball-out will be defined for purposes herein as an injection rate less than 0.1 barrels per minute. Preferably, a slow injection rate will be continued in well 20 to maintain pressure at the perforations at least above estimated reservoir pressure around the well during the fracturing treatment, so as to ensure that flow into the well does not unseat a ball or backflow particles. Alternatively, pressure in the wellbore at the perforations may be obtained above fracturing pressure to ensure that no fluid enters the well. The surface pressure may be maintained on well 20 during the hydraulic fracturing treatment of well 10 and until pressure decreases around well 10 and well 20 after the treatment. This will allow a much smaller injection of fluid into well 20 than would be required without use of the ball sealers 30 or particulate material 31 and leave a lower water saturation around producing well 20, providing a higher production rate.

Degradable ball sealers and degradable particles may be obtained from pumping service companies in the industry.

A variety of degradable materials may be used in the ball sealers or particulate material. For example, the degradable material may be a polymer that degrades in contact with water, such as a polyester. Other degradable materials such as metal degradable material that degrade under reservoir conditions are also widely available in industry.

After the hydraulic fracturing treatment is completed in well 10, production may be restarted from well 20. Ball sealers or particles 31 may degrade before being produced with production from well 20, or they may not be recovered if fully degraded. Degradation of ball sealers 30 or particles 31, however, will assure that no perforations are plugged by using ball sealers to seal perforations 22.

Although the present invention has been described with respect to specific details, it is not intended that such details should be regarded as limitations on the scope of the invention, except to the extent that they are included in the accompanying claims.

What is claimed is:

1. A method for preventing influx of fluid into a first well having casing during or immediately after the time of a hydraulic fracturing treatment of a plurality of offset wells completed in the same reservoir, comprising:

providing a quantity of ball sealers and degradable particles;

injecting the quantity of ball sealers or degradable particles together into the first well in a carrier fluid to plug or partially plug perforations or ports in the casing of the first well; and hydraulically fracturing the plurality of the offset wells while maintaining pressure in the first well so as to maintain plugging or partial plugging of the perforations or port in the first well, thereby preventing influx of fluid from the plurality of the offset wells into the first well as a result of hydraulically fracturing the plurality of the offset wells.

2. The method of claim 1 wherein the carrier fluid is water or fracturing fluid.

3. The method of claim 1 wherein the quantity of ball sealers and degradable particles is sufficient to provide partial or complete shut-off of the perforations.

4. The method of claim 1 wherein a surface pressure is maintained via a slow injection rate on the first well during the hydraulic fracturing of the plurality of the offset wells.

5. The method of claim 4 wherein the surface pressure is maintained via the slow injection rate until pressure decreases around the plurality of the offset wells after the hydraulic fracturing.

6. The method of claim 4 wherein the surface pressure is maintained via the slow injection rate until pressure decreases around the first well after the hydraulic fracturing.

7. The method of claim 1 wherein the ball sealers and degradable particles each comprise a degradable polymer.

8. The method of claim 7 wherein the degradable polymer comprises polyester.

9. The method of claim 1 wherein the ball sealers and degradable particles each comprise a metal degradable material.

10. The method of claim 1 wherein production from the first well is restarted after completion of the hydraulic fracturing of the plurality of the offset wells.

11. A method for preventing influx of fluid into a first well having casing during or immediately after the time of a hydraulic fracturing treatment of a plurality of offset wells completed in the same reservoir, comprising:

providing a quantity of degradable particles;

injecting the quantity of degradable particles together into the first well in a carrier fluid to plug or partially plug perforations or ports in the casing of the first well; and hydraulically fracturing the plurality of the offset wells while maintaining pressure in the first well so as to maintain plugging or partial plugging of the perforations or port in the first well, thereby preventing influx of fluid from the plurality of offset wells into the first well as a result of hydraulically fracturing the plurality of offset wells.

12. The method of claim 11 wherein the carrier fluid is water or fracturing fluid.

13. The method of claim 11 wherein the quantity of degradable particles is sufficient to provide partial or complete shut-off of the perforations.

14. The method of claim 11 wherein a surface pressure is maintained via a slow injection rate on the first well during the hydraulic fracturing of the plurality of offset wells.

15. The method of claim 14 wherein the surface pressure is maintained via the slow injection rate until pressure decreases around the plurality of offset wells after the hydraulic fracturing.

16. The method of claim 14 wherein the surface pressure is maintained via the slow injection rate until pressure decreases around the first well after the hydraulic fracturing.

17. The method of claim 11 wherein the degradable particles each comprise a degradable polymer.

18. The method of claim 17 wherein the degradable polymer comprises polyester.

19. The method of claim 11 wherein the degradable particles each comprise a metal degradable material.

20. The method of claim 11 wherein production from the first well is restarted after completion of the hydraulic fracturing of the plurality of offset wells.

* * * * *